US007722023B2

(12) United States Patent
Hattori

(10) Patent No.: US 7,722,023 B2
(45) Date of Patent: May 25, 2010

(54) BOOKBINDING APPARATUS AND BOOKBINDING SYSTEM

(75) Inventor: Masato Hattori, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 6 days.

(21) Appl. No.: 12/106,572

(22) Filed: Apr. 21, 2008

(65) Prior Publication Data

US 2009/0079123 A1 Mar. 26, 2009

(30) Foreign Application Priority Data

Sep. 26, 2007 (JP) ..... 2007-248797

(51) Int. Cl.

| | |
|---|---|
| ***B65H 33/04*** | (2006.01) |
| ***B65H 39/00*** | (2006.01) |
| ***B42C 9/00*** | (2006.01) |
| ***B42C 11/00*** | (2006.01) |
| ***B42C 11/02*** | (2006.01) |

(52) U.S. Cl. ..... 270/58.07; 270/58.08; 270/58.09; 412/1; 412/4; 412/8; 412/19

(58) Field of Classification Search ..... 270/58.07, 270/58.08, 58.09

See application file for complete search history.

(56) References Cited

U.S. PATENT DOCUMENTS 6,193,458 B1 * 2/2001 Marsh ..... 412/1
2008/0267735 A1 * 10/2008 Hama ..... 412/37

* cited by examiner

*Primary Examiner*—Gene Crawford
*Assistant Examiner*—Yolanda Cumbess
(74) *Attorney, Agent, or Firm*—Finnegan, Henderson, Farabow, Garrett & Dunner, L.L.P.

(57) ABSTRACT

The problem of unevenness that an outer shape is different for each booklet is solved by correcting coating thickness control depending on a thickness of a sheet bundle, based on booklet information which includes information on at least the number of sheets constituting the sheet bundle, keeping adjustment of a coating thickness for adhesive depending on a thickness of a sheet bundle as a basic method.

13 Claims, 9 Drawing Sheets

BOOKBINDING APPARATUS AND BOOKBINDING SYSTEM

This application is based on Japanese Patent Application No. 2007-248797 filed on Sep. 26, 2007 in Japanese Patent Office, the entire content of which is hereby incorporated by reference.

BACKGROUND OF THE INVENTION

The present invention relates to a bookbinding apparatus to make a booklet by coating adhesive on a spine of a sheet bundle and to a bookbinding system equipped with the aforesaid bookbinding apparatus and with an image forming apparatus that forms images on a sheet.

A bookbinding apparatus for binding a sheet bundle composed of a plurality of sheets through gluing which is conducted by moving a coating device along a spine of the sheet bundle has been developed as a small-sized binding apparatus.

In particular, the aforesaid bookbinding apparatus has been developed as s small-sized bookbinding apparatus to be used for a bookbinding system wherein an image forming progress for forming an image on a sheet with an image forming apparatus and a bookbinding progress for binding sheets are conducted in a continuous progress.

For example, in Japanese Patent Publication Open to Public Inspection No. 2006-346984, there is proposed a bookbinding apparatus for conducting coating by moving a coating device along a spine of a sheet bundle wherein coating is conducted through first coating operations by bringing the coating device into contact with a spine of the sheet bundle under strong contact pressure and through second coating operations under weak contact pressure.

The bookbinding apparatus in Japanese Patent Publication Open to Public Inspection No. 2006-346984 conducts the aforesaid first and second coating operations for the purpose of making adhesion between sheets constituting a sheet bundle to be sure and of making adhesion of a cover to be sure.

By changing a thickness of coating of an adhesive layer formed on a spine of a sheet bundle depending on a thickness of a booklet, it is possible to produce a high-quality booklet, and thereby the quality is stabilized.

The reasons for the foregoing are as follows.

In the case of a thick booklet, it is necessary to make a coating thickness to be thick for obtaining necessary adhesive strength. However, if a coating thickness is made to be thick in the same way in the case of a thin booklet, adhesive is squeezed out as side adhesive when wrapping with a cover, resulting in excessive adhesive and poor binding.

On the other hand, when a booklet is thin, sufficient adhesive strength can be obtained even when a coating thickness is relatively thin.

As is suggested in Japanese Patent Publication Open to Public Inspection No. 2006-346984, changing coating conditions depending on a thickness of a sheet bundle is a powerful technique to solve the aforesaid problems. In other words, by changing a coating amount of adhesive depending on a thickness of a sheet bundle, the problems mentioned above can be solved to a certain extent.

However, when conducting coating control based on a thickness of a sheet bundle, a thickness of a formed adhesive layer is changed for each sheet bundle, and an external form of a sheet bundle or an external form of a booklet prepared by joining a cover on a sheet bundle shows lack of uniformity, which is a problem.

The lack of uniformity of the sheet bundle or of the booklet is especially remarkable in the following occasions.

For changing a coating weight depending on a thickness of the sheet bundle, there is employed a controlling method wherein a prescribed thickness represents a threshold value, and when a thickness is the threshold value or higher, a coating amount is increased, while, when a thickness is less than the threshold value, a coating amount is decreased.

When binding processing is continued for sheet bundles each having a thickness close to the threshold value, there is sometimes an occasion wherein a judgment for control of a coating thickness is changed for every sheet bundle even when the number of sheets is the same, resulting in formation of adhesive layers each being different for every sheet bundle.

FIG. 1 shows schematically situations of the prepared booklets wherein adhesive layers which are different in terms of a thickness are formed for every sheet bundle even when the number of sheets in a sheet bundle is the same, as described above.

As a result of adhesive layers N1-N4 of booklets P1-P4 which are different from each other in terms of a thickness, when the booklets P1-P4 are aligned at the reference position of their spines, ends Q1-Q4 of the booklets show lack of uniformity.

In other words, as a result of control of coating amount, there is caused a problem that consistency of booklets is lowered and quality of booklets is lowered.

SUMMARY

The aforesaid problems are solved by the following embodiments of the invention.

1. A bookbinding apparatus which coats adhesive on a spine of a sheet bundle by moving relatively the sheet bundle or a coating device which coats adhesive to the spine of the sheet bundle, the bookbinding apparatus comprising: a thickness information generating device which generates information on a thickness of the sheet bundle, a booklet information generating device which generates booklet information including at least information on the number of sheets constituting the sheet bundle, and a control device which conducts an adjustment of a coating thickness of a layer of the adhesive coated on the spine of the sheet bundle based on information on the thickness of the sheet bundle coming from the thickness information generating device and which corrects the adjustment having been conducted based on the thickness of the sheet bundle, based on the booklet information coming from the booklet information generating device.

2. A bookbinding system characterized by having an image forming apparatus that forms an image on a sheet and the bookbinding apparatus of Item 1 that conducts bookbinding processing for the sheets ejected from the image forming apparatus.

DETAILED DESCRIPTION OF THE PREFERRED EMBODIMENT

The invention will be described as follows based on an embodiment to which, however, the invention is not limited.

Figure 2:
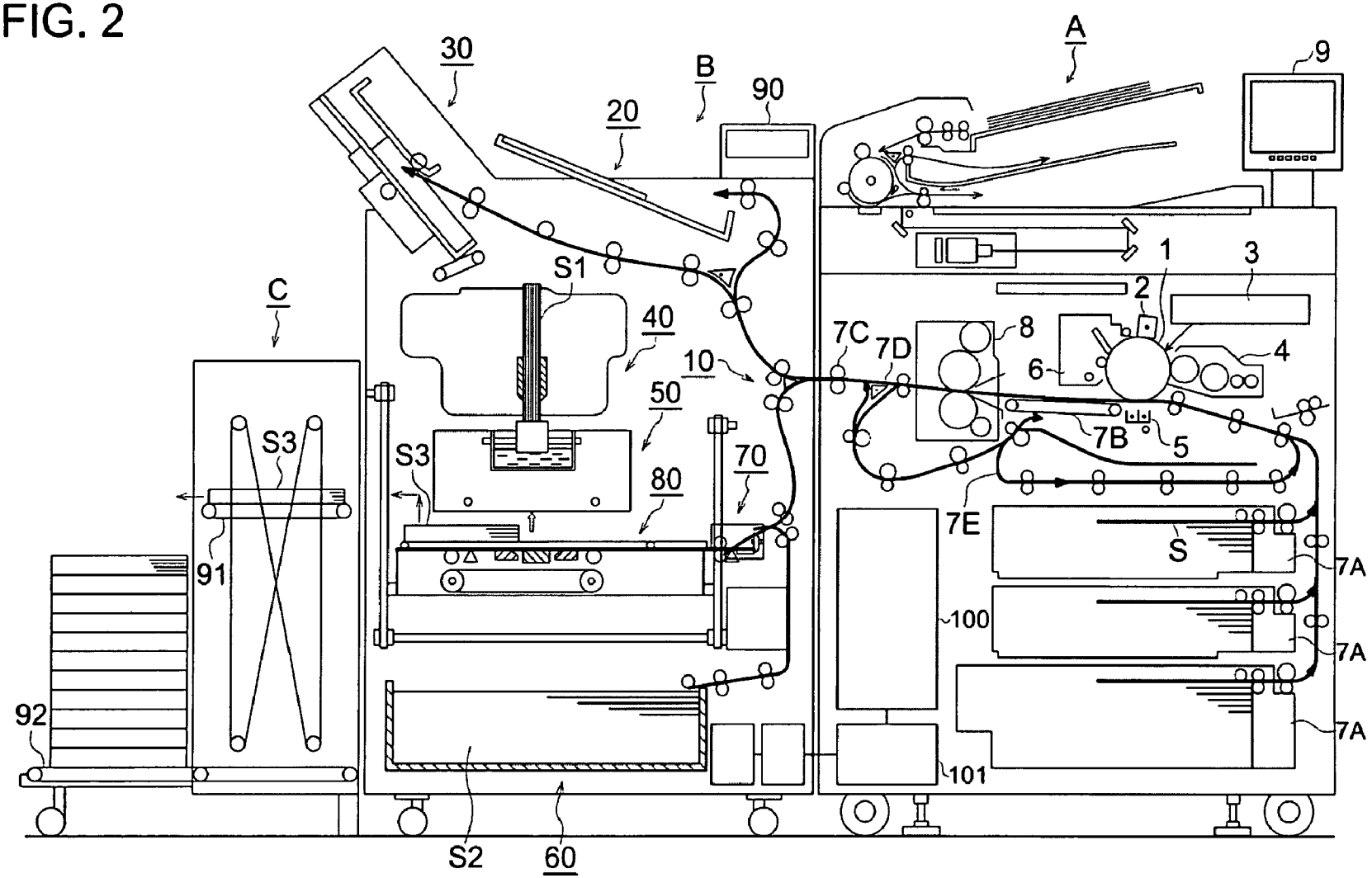
FIG. 2 is a diagram showing an overall structure of a bookbinding system.

FIG. 2 is a diagram showing an overall structure of a bookbinding system relating to the embodiment of the invention.

The bookbinding system illustrated is composed of image forming apparatus A and bookbinding apparatus B. Incidentally, in the present embodiment, booklet reception apparatus C that receives a bound booklet is connected to the aforesaid bookbinding apparatus B.

First, an outline of the image forming apparatus and the bookbinding apparatus will be described.

<Image Forming Apparatus A>

Image forming apparatus A has an image forming device wherein charging device 2, image exposure device 3, developing device 4, transfer neutralizing device 5 and cleaning device 6 are arranged around image carrier 1 that rotates.

After a surface of the image carrier 1 is charged evenly by the charging device 2, the image forming device conducts exposure scanning that is based on image data which have been read out from a document by a laser beam of the image exposure device 3, to form a latent image, and conducts reversal development for the latent image with the developing device 4 to form a toner image on a surface of the image carrier 1.

Sheet S fed out of sheet storage device 7A is conveyed to a position for transfer. After the toner image is transferred onto sheet S by the transfer neutralizing device 5 at the position for transfer, electric charges on sheet S are eliminated, and sheet S is separated from the image carrier 1 and is conveyed by conveyance device 7B to be heated and fixed by fixing device 8 successively, and is ejected from ejection roller 7C.

When forming images on both sides of sheet S, sheet S heated and fixed by the fixing device 8 is caused by conveyance path switching device 7D to branch off a regular sheet ejection path, and is conveyed again to the image forming apparatus so that an image is formed on the reverse side of the sheet S, after it is reversed inside out on a switchback basis in reverse conveyance device 7E.

Sheet S1 subjected to fixing processing by fixing device 8 is ejected out from sheet ejection roller 7C to the outside of the apparatus. The sheet S ejected out of the sheet ejection roller 7C is fed into bookbinding apparatus B.

A surface of the image carrier 1 after image treatment is cleaned by cleaning device 6 and developing agents remaining on the surface are removed, thus, the surface becomes ready for the following image forming.

On the upper portion of image forming apparatus A, there is arranged operation display device 9 that is equipped with an input device and a display device.

<Bookbinding Apparatus B>

Bookbinding apparatus B is equipped with sheet conveyance device 10, sheet ejection device 20, sheet bundle reception device 30, sheet bundle conveyance device 40, adhesive coating device 50, cover supply device 60, cover cutting device 70, cover supporting device 80 and operation display device 90.

The sheet S on which an image is formed by image forming apparatus A is conveyed by sheet conveyance device 10, and a plurality of sheets S are stacked by sheet bundle reception device 30, thus, sheet bundle S1 is formed.

The sheet bundle S1 is conveyed to a prescribed position by the sheet bundle conveyance device 40, and adhesive is coated on a spine of the sheet bundle S1 by the adhesive coating device 50.

Cover sheet S2 supported by the cover supporting device 80 is bonded on a spine of the sheet bundle S1 on which adhesive is coated, then, the cover sheet S2 is folded along both edges of the spine of the sheet bundle S1, whereby, booklet S3 is completed.

Next, each process of bookbinding will be described in detail.

Sheet S brought into the sheet conveyance device 10 is conveyed by plural conveyance rollers and by a conveyance path switching gate to any one of the sheet ejection device 20, sheet bundle reception device 30, and cover supporting device 80.

When the bookbinding processing is not designated, sheet S ejected out of image forming apparatus A is ejected directly to a sheet ejection tray of the sheet ejection device 20 through setting of the conveyance path switching gate.

Figure 3:
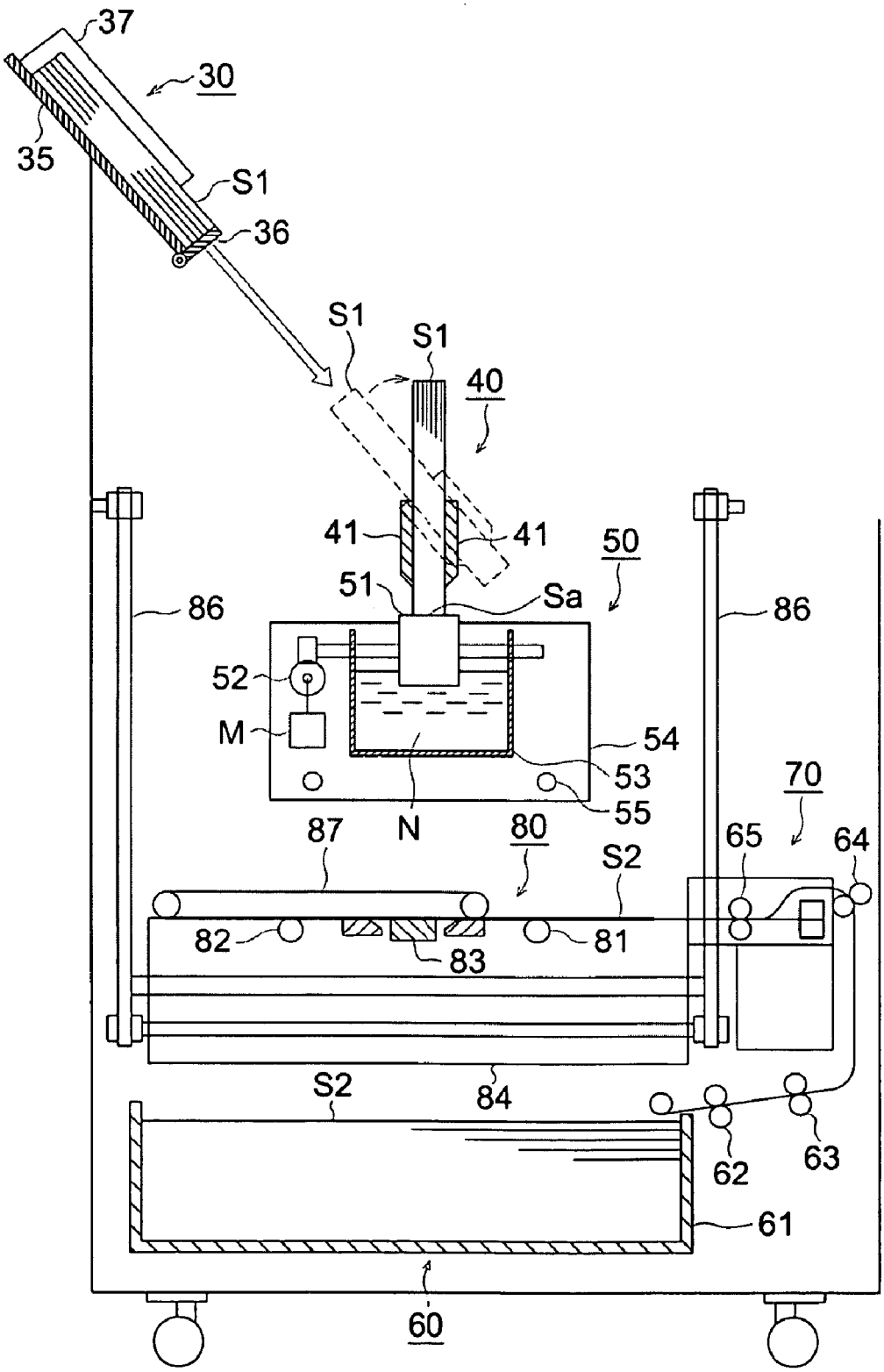
FIG. 3 is a diagram showing the structure of a bookbinding apparatus illustrating forming of a sheet bundle and processes thereafter.

FIG. 3 is a diagram showing the structure of a bookbinding apparatus for illustrating forming of sheet bundle S1 and processes thereafter.

The sheet bundle reception device 30 has therein sheet placing stand 35 arranged obliquely, sheet trailing edge positioning member 36 that is movable and aligning member 37 that conducts alignment in the sheet lateral direction.

A sheet ejected out of image forming apparatus A and sent by the aforesaid sheet conveyance device 10 is placed on the aforesaid sheet placing stand 35 successively, thus, sheet bundle S1 composed of a prescribed number of sheets is formed.

After sheet bundle S1 that is placed on sheet placing stand 35 of the sheet bundle reception device 30 has been aligned, it is grasped by grasping device 41. After the sheet S1 has been grasped by the grasping device 41, sheet trailing edge positioning member 36 is moved by an unillustrated driving device to retreats toward the lower portion of the sheet placing stand 35.

The grasping device 41 grasping the sheet bundle S1 moves downward obliquely as shown by illustrated broken lines, and then, swings and stops at a prescribed position while holding the sheet bundle S1 vertically so that spine Sa on which the adhesive coating processing is conducted on the sheet bundle S1 may come to the lower side.

On the other hand, cover sheet S2 stored in cover sheet stacking device 61 of the cover supply device 60 is separated and fed by sheet feeding device 62, then, is pinched by conveyance rollers 63, 64 and 65 to be conveyed by conveyance rollers 81 and 82 of the cover supporting device 80, and is stopped at a prescribed position.

When the cover sheet S2 is longer than a necessary length in the case of conducting wrapping bookbinding processing for sheet bundle S1, the cover sheet S2 is cut by cover cutting device 70 that is arranged on the right side in the illustration of conveyance roller 65, so that an excessive portion may be removed in advance.

Figure 4:
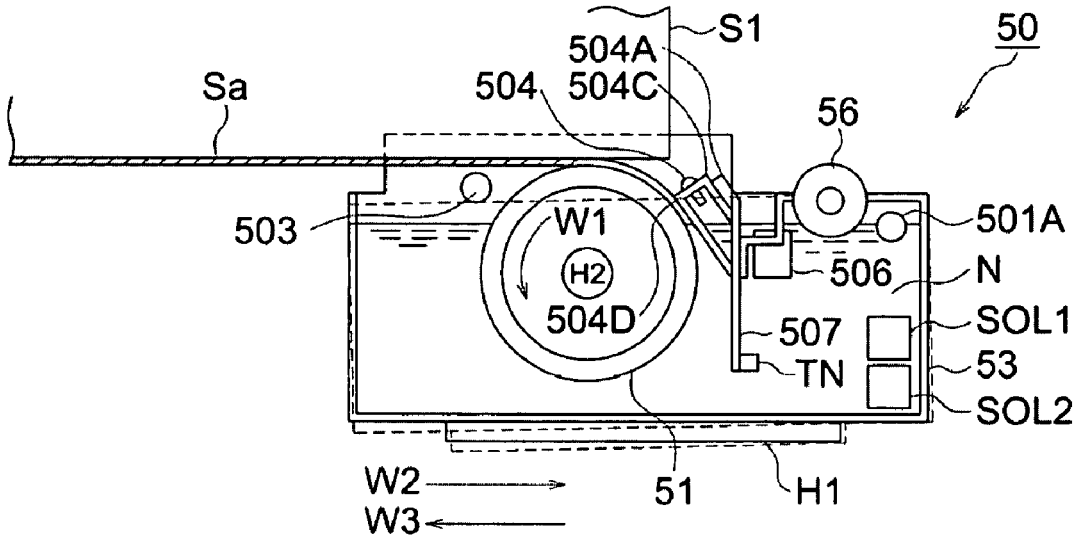
FIG. 4 is a diagram showing a structure of an adhesive coating device.
Figure 5:
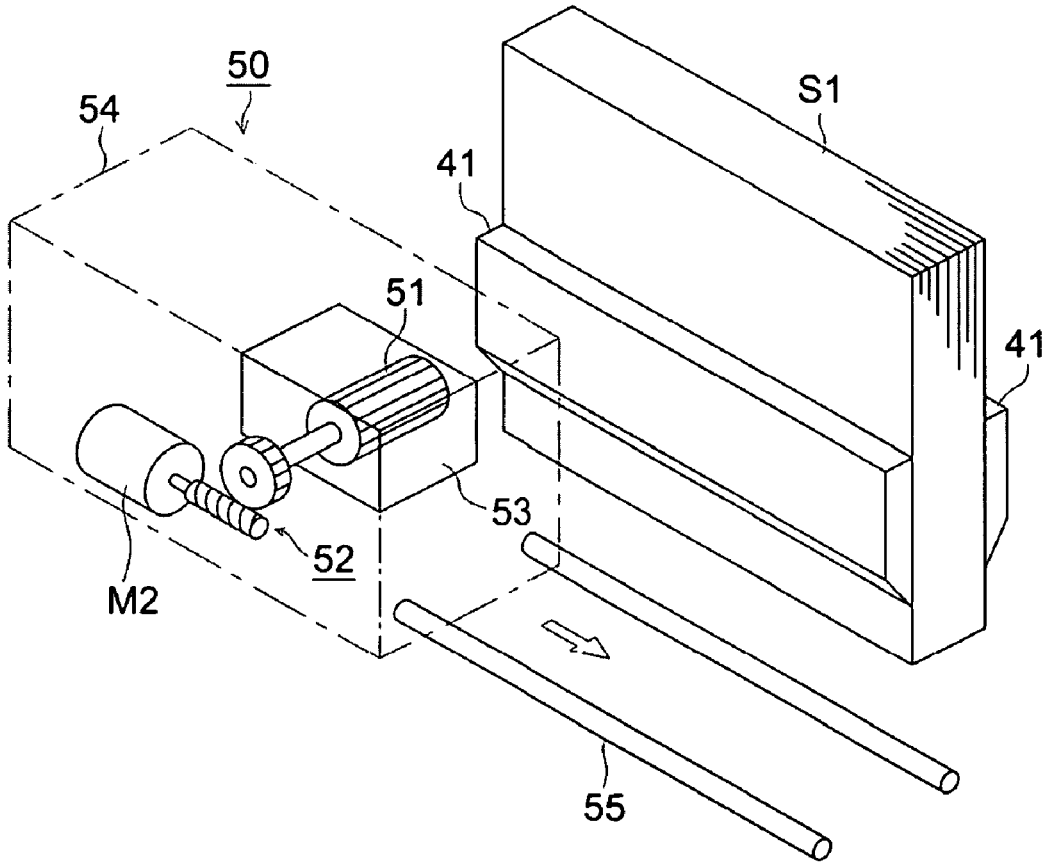
FIG. 5 is a perspective view showing an adhesive coating device and a sheet bundle grasped by a grasping device.
Figure 6:
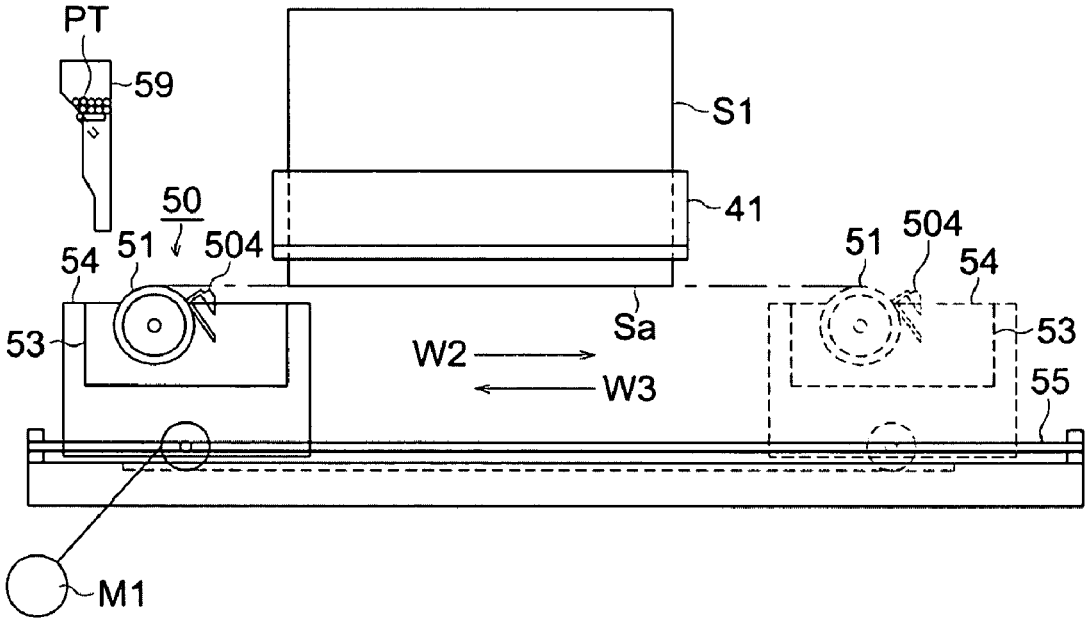
FIGS. 6(*a*) and 6(*b*) are diagrams illustrating movements of an adhesive coating device.
Figure 6:
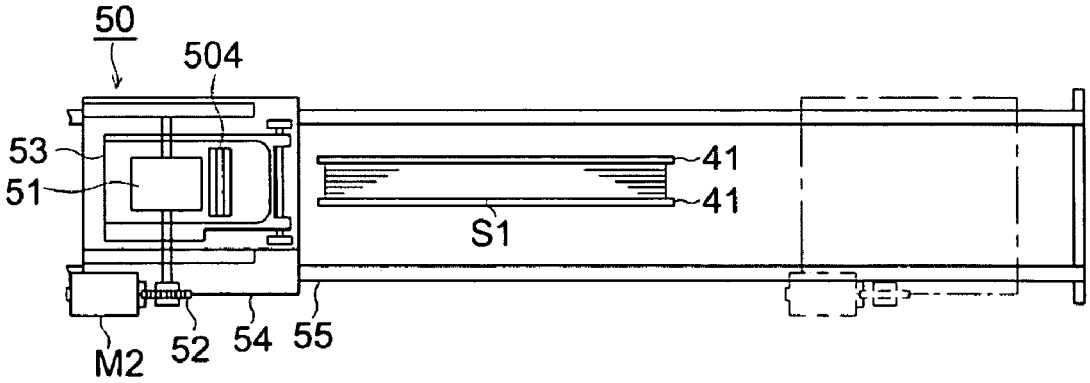

FIG. 4 is a diagram showing a structure of adhesive coating device 50. FIG. 5 is a perspective view showing adhesive coating device 50 and sheet bundle S1 that is grasped by grasping device 41, and FIGS. 6(*a*) and 6(*b*) are diagrams illustrating movements of adhesive coating device 50. Meanwhile, FIG. 6 (*a*) shows a side view, and FIG. 6(*b*) shows a top view.

The adhesive coating device 50 has therein melting tank 53 representing a containing member that contains adhesive N, coating roller 51 representing a coating member, regulating members 503 and 504, heaters H1 and H2, adhesive temperature sensor TN and residual quantity sensor 506.

The numeral 59 represents a replenishing device that replenishes solid adhesives PT, and it replenishes lump-shaped solid adhesives PT based on signals of residual quantity sensor 506 that detects an amount of adhesive in melting tank 53. Meanwhile, heaters H1 and H2 are provided on the outer circumferential portion of the melting tank 53 and in coating roller 51, and solid adhesive PT replenished to the melting tank 53 is heated up to the prescribed temperature to be melted to become adhesive N before coating.

Solid adhesive PT is replenished from replenishing device 59 depending on detection signals of residual quantity sensor 506, to maintain the amount of adhesive N so that a surface of a liquid may be constant.

The numeral 503 represents a bar-shaped regulating member whose section is substantially a circle, and 504 represents a regulating member which is fixed on a plate-shaped supporting member 507 through screw cramp on both end portions outside the coating area. The melting tank 503 is set so as to be rotated around shaft 501A from the state of standby shown with dotted lines to the state of coating shown with solid lines.

The regulating member 504 is a device to scrape off with primary scraping portion 504A on the uppermost edge portion and with auxiliary scraping portion 504C located to be slightly lower than the primary scraping portion 504A, so that adhesive coated on a spine of sheet bundle S1 by coating roller 51 may become the prescribed thickness.

A regulating member that regulates a thickness of an adhesive layer on coating roller 51 is represented by 504D.

The regulating member 503 is a member that is arranged on the opposite side of coating roller 51 from the aforesaid regulating member 504 and regulates a coating thickness of adhesive.

The numeral 56 represents a shaping roller that regulates a thickness of adhesive layer NL formed on spine Sa.

The numeral 54 represents a movable body that supports melting tank 53. The movable body 54 starts moving in the direction W2 from an initial position (left end in FIG. 6(*a*)) on the back side of bookbinding apparatus B, then, moves along guide 55, and is driven to be reversed in the direction W3 to return to the initial position, after being stopped at the prescribed position on the front side of bookbinding apparatus B.

That is, coating of adhesive on spine Sa of sheet bundle S1 held vertically is conducted in the manner wherein coating roller 51 that is dipped in adhesive in melting tank 53 and is driven by motor M2 to rotate is caused to reciprocate on spine Sa of a sheet bundle, and an amount of coating for adhesive N is regulated mainly by regulating member 503 in the case of the outward movement (direction W2), and is regulated mainly by regulating member 504 and by shaping roller 56 in the case of the homeward movement (direction W3).

Solenoid SOL1 moves coating device 50 vertically, and solenoid SOL2 rotates melting tank 53 between a position of solid lines and a position of dotted lines in FIG. 4.

In the case of coating on the outward trip, melting tank 53 is set to the state of solid lines by "ON" of solenoid SOL2, and regulating member 503 regulates a coating thickness.

In the case of coating on the homeward trip, melting tank 53 is set to the state of dotted lines by "OFF" of solenoid SOL2, and regulating member 504 and shaping roller 56 regulate a coating thickness.

Figure 7:
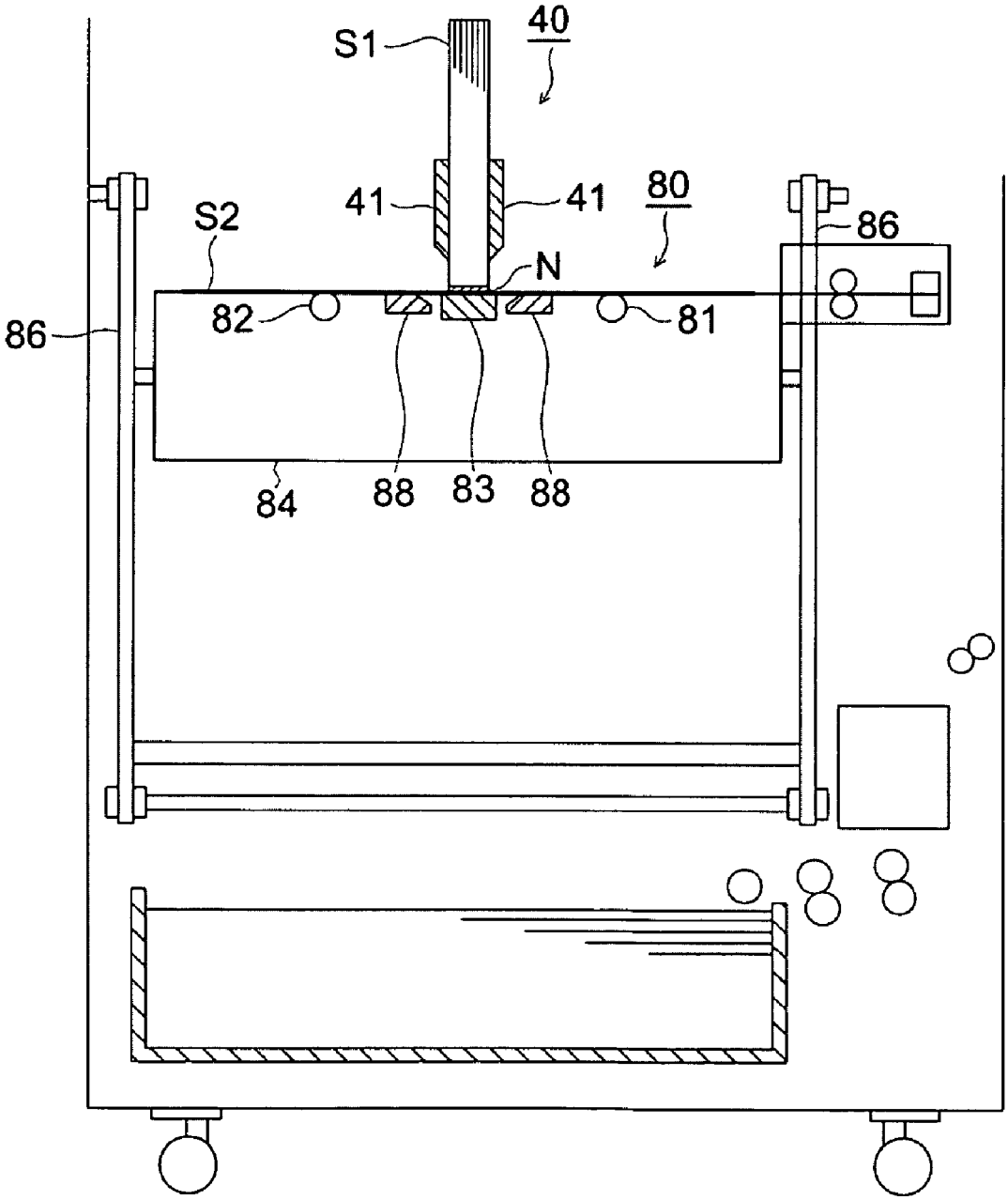
FIG. 7 is a conceptual diagram showing positions of a sheet bundle conveyance device and of a cover sheet supporting device.

FIG. 7 is a conceptual diagram showing positions of sheet bundle conveyance device 40 and of cover supporting device 80, in the case of conducting gluing processing between sheet bundle S1 and cover sheet S2.

After completion of coating adhesive on sheet bundle S1, elevating device 86 moves movable casing 84 to the elevated position representing a prescribed position with an unillustrated driving device. At this elevated position, a central portion of cover sheet S2 placed on pressure member 83 is brought into pressure contact with a surface of sheet bundle S1 coated with adhesive, to be bonded thereon.

Figure 8:
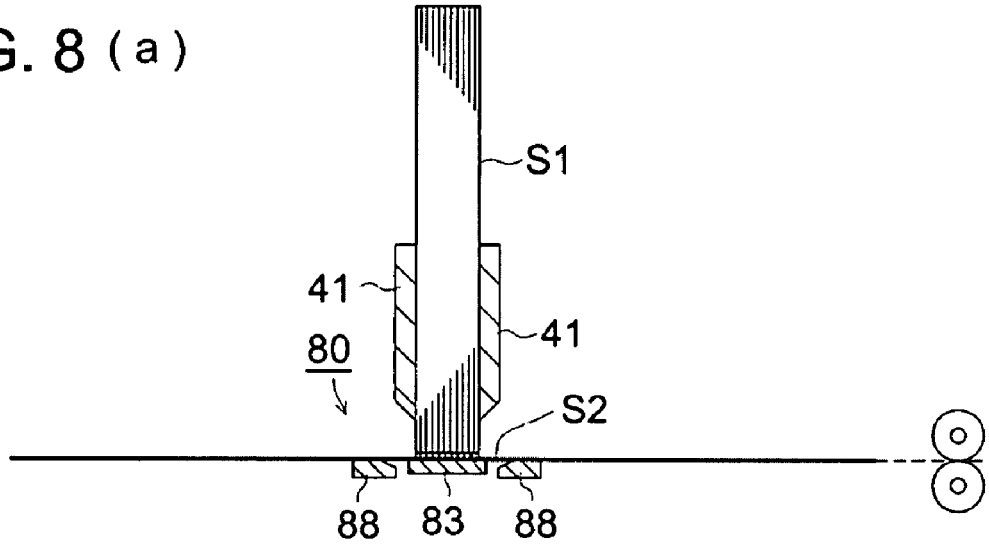
FIGS. 8(*a*)-8(*d*) are cross-sectional views of a cover sheet supporting device and a sheet bundle showing a folding process for a cover sheet.
Figure 8:
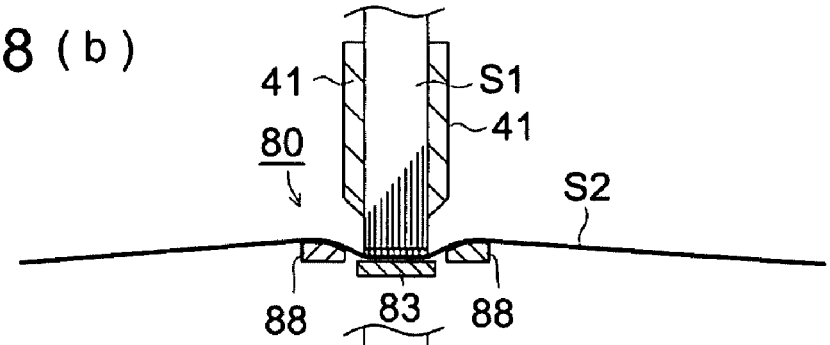
Figure 8:
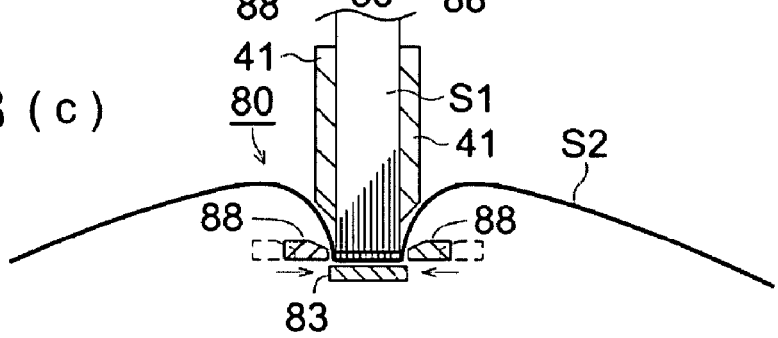
Figure 8:
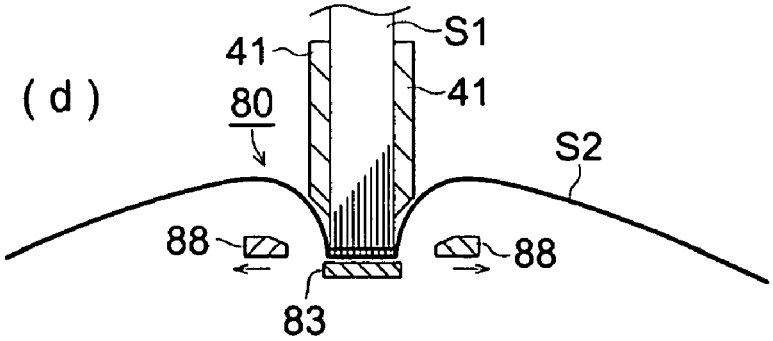

FIGS. 8(*a*)-8(*d*) are cross-sectional views of cover supporting device 80 and sheet bundle S1 showing a folding process for cover sheet S2, and FIG. 8(*a*) shows a moment to start folding a cover sheet, FIG. 8(*b*) shows an intermediate moment for cover sheet folding, FIG. 8(*c*) shows a moment of termination of cover sheet folding and FIG. 8(*d*) shows a moment of releasing pressurization for cover folding.

After cover sheet S2 is bonded on spine Sa of sheet bundle S1 on which adhesive N is coated, paired folding members 88 are driven by an unillustrated driving device, in the course of an ascending state of cover supporting device 80 shown in FIG. 7. Then, grasping device 41 that is grasping the sheet bundle S1 descends. Owing to descending of the sheet bundle S1, cover sheet S2 descends while being supported by the paired folding members 88, and is bent on side edge portions of adhesive-coated surface of the sheet bundle S1.

After that, the paired folding members 88 move toward the adhesive-coated surface side of sheet bundle S1 in the horizontal direction to shape both sides of the sheet bundle S1 by pressing them, and form booklet S3.

Figure 1:
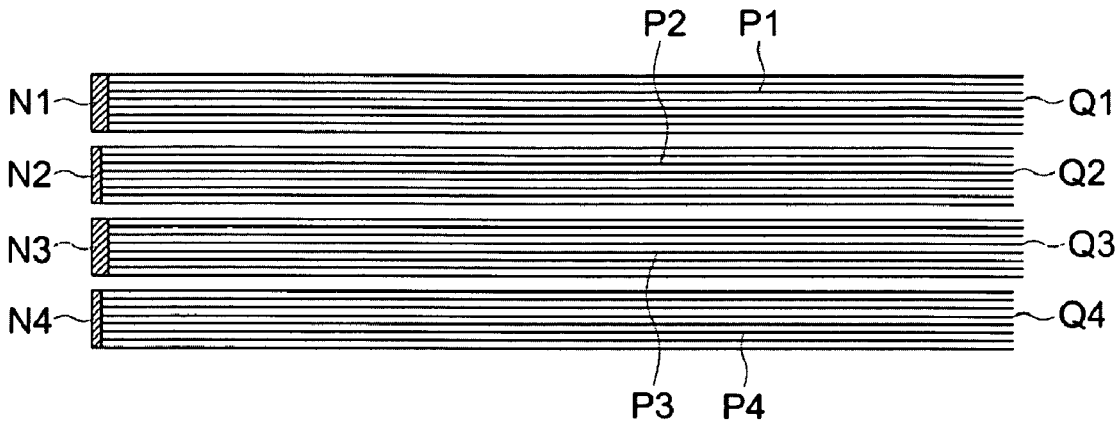
FIG. 1 is a diagram illustrating fluctuations of outer shapes of booklets caused by coating thicknesses.

The booklet 3 which has been ejected by ejection belt 87 (see FIG. 3) is placed on conveyance belt 91 of booklet storing device C shown in FIG. 1, which is capable of ascending and descending, and is ejected successively by rotation of the conveyance belt 91 to be stacked on sheet ejection stand 92 to be stored.

<Coating Thickness Control>

Adjustment of a coating thickness of adhesive formed on spine Sa of sheet bundle S1 will be described.

As described above, coating of adhesive is conducted by one reciprocation of coating device 50.

A thickness of an adhesive layer formed by one reciprocation of coating device 50 is determined mainly by coating process of a homeward trip.

Coating operations in a homeward trip of the coating device 50 will be described as follows, referring to FIG. 9.

When the coating device 50 moves in the direction W3, coating roller 51 rotates in the counterclockwise direction W1, to apply adhesive N on spine Sa of booklet bundle P.

That is, when the coating device 50 moves in the direction W3, a circumferential surface of the coating roller 51 rotates in the counter direction that increases relative velocity caused between booklet S1 and the circumferential surface, and coating is carried out.

Figure 9:
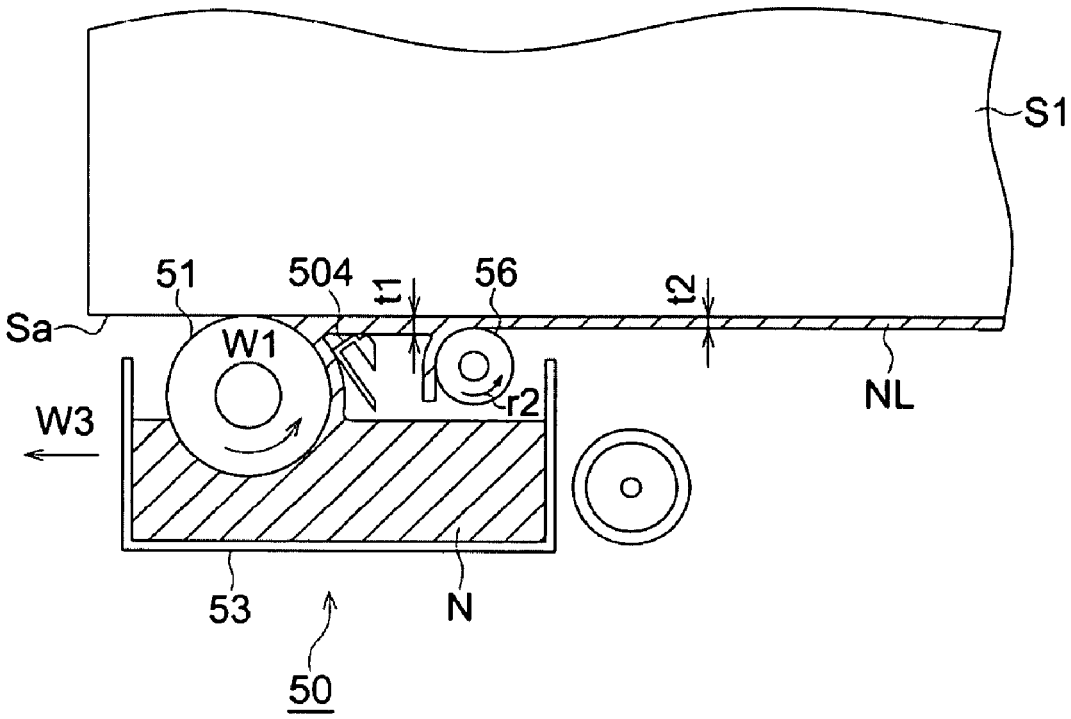
FIG. 9 is a diagram showing an adhesive coating process.

Adhesive N thus applied is shaped by regulating member 504 to be of a thickness of t1 in FIG. 9, and then, is shaped by shaping roller 56 to be of a thickness of t2.

Since a speed of the coating device 50 to move in the direction W3 and a rotating speed of the coating roller 51 are constant, a thickness of coated adhesive layer NL is determined by clearances between spine Sa and each of the coating roller 51, regulating member 504 and the shaping roller 56.

In the illustrated coating device 50, heights of the coating roller 51, the regulating member 504 and of the shaping roller 56 are adjusted by solenoid SOL1 (see FIG. 4), and thereby, a thickness of adhesive layer NL is adjusted.

In other words, when the coating roller 51, the regulating member 504 and the shaping roller 56 are set respectively at high positions, so that a distance between each of these items and spine Sa is made to be narrow, thin adhesive layer NL is formed, and when these items are set respectively at low positions, so that a distance between each of them and spine Sa is made to be broad, thick adhesive layer NL is formed.

A thickness of adhesive layer NL is adjusted in the aforesaid way based on a thickness of booklet bundle S1.

As shown in FIG. 9, the coating thickness means thickness t2 of adhesive layer NL that is formed on sheet bundle S1 after coating process, and a thickness of the adhesive layer after drying is determined by the value of the coating thickness t2.

That is, a thickness of adhesive layer NL is controlled by making thickness t2 of adhesive layer NL thick when booklet bundle S1 is thick, and by making thickness t2 of adhesive layer NL thin when booklet bundle S1 is thin.

In the example described above, coating thickness t2 is determined mainly by a distance between a circumferential surface of shaping roller 56 and spine Sa, and control of the coating thickness is determined by a direction of rotation and a rotation speed of coating roller 51, and by a movement speed of adhesive coating device 50.

By the control of a coating thickness of this kind, a phenomenon that is called a side adhesive wherein coated adhesive spreads up to a sheet surface of a booklet from spine Sa can be prevented in a thin booklet bookbinding process, and the strength necessary for a thick booklet can be secured.

In the typical example of the control of this kind for a coating thickness of adhesive, information on a booklet thickness is distinguished by using a prescribed threshold value, and when the thickness is not smaller than the threshold value, thick coating is conducted, and when the thickness is smaller than the threshold value, thin coating is conducted.

When the coating thickness control of this kind is conducted, unevenness is caused on the finish of the booklet as described above, and quality of the booklet is lowered.

In the invention, the aforesaid problems have been solved by conducting coating thickness control by adding booklet information including at least information on the number of sheets constituting sheet bundle S1 to information on the thickness of sheet bundle S1, while keeping the adjustment of a coating thickness of adhesive layer NL based on a thickness of sheet bundle S1 as a fundamental method.

Figure 10:
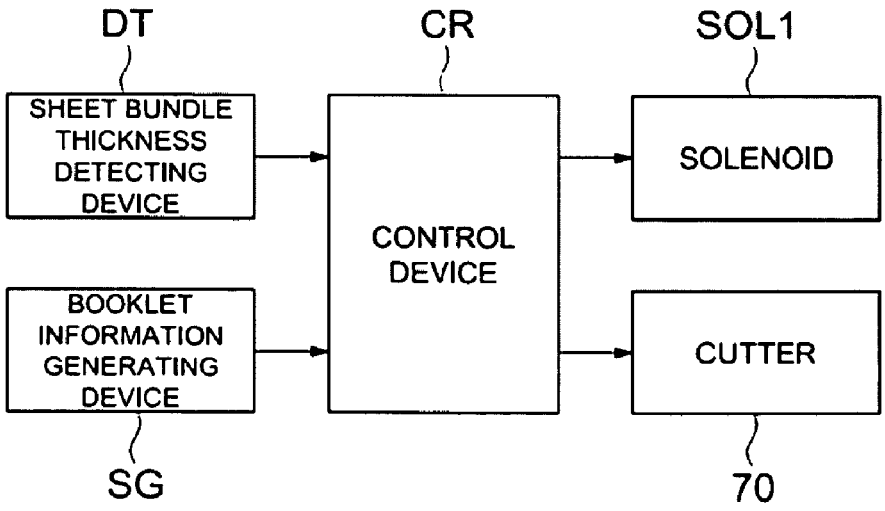
FIG. 10 is a block diagram of a control system that conducts control of coating thickness and conducts control of cutting of a cover sheet.

FIG. 10 is a block diagram of a control system that conducts control of coating thickness and conducts control of cutting of a cover sheet.

Control device CR controls a coating thickness by controlling solenoid SOL1 that controls a position of coating device 50, based on information from sheet bundle thickness detector DT constituting a thickness information generating device, and corrects the coating thickness control based on information on sheet bundle thickness detector DT based on information from booklet information generating device SG.

The sheet bundle thickness detector is one to detect a distance between paired grasping devices 41 (see FIG. 3).

Further, booklet information generating device SG is a device to generate information on at least the number of sheets constituting a sheet bundle, and it includes a communication device that conducts communication with operation display device 9 (see FIG. 1) and with outer equipment.

In addition to the information on the number of sheets, booklet information generated by the booklet information generating device SG can include at least one of information on a sheet thickness, information on a sheet size and information on a sheet type.

Control device CR controls an amount of feeding for cover sheet S2 to be fed to cutter 70, based on information from the booklet information generating device SG and on information from the sheet bundle thickness detector DT.

Since a cover sheet is cut to the length of cover sheet S2 according to a sheet size and a sheet bundle thickness, by the control of an amount of feeding of cover sheet S2 of this kind, a cover sheet suitable for a sheet size and various sheet bundle thicknesses is prepared, and is joined with a bundle for a booklet.

Figure 11:
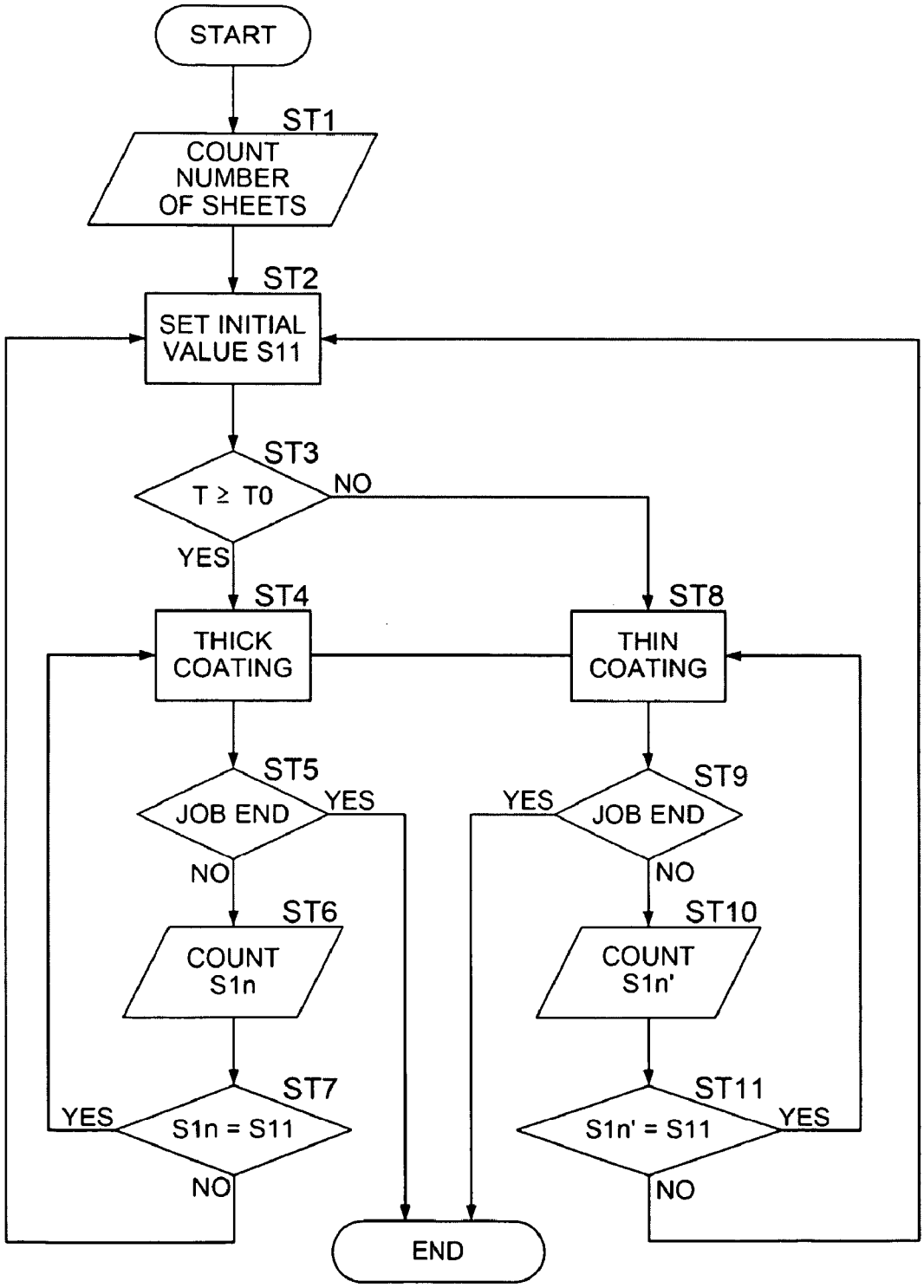
FIG. 11 is a flow chart of a coating thickness control in an example of the embodiment of the invention.

FIG. 11 is a flow chart of a coating thickness control in an example of the embodiment of the invention.

In FIG. 11, S11-S1*n* represent the number of sheets constituting the first sheet bundle-$n^{th}$ sheet bundle.

In step ST1, the number of sheets S11 of sheets constituting the first sheet bundle is counted. This number of sheets is a counted number of sheets S accumulated in sheet storing device 30 (see FIG. 1).

In step ST2, the number of sheets S11 thus counted is set as an initial value.

In step ST3, a thickness of sheet bundle is judged whether the number of sheets S11 thus counted is smaller than the threshold value (for example, 7 mm) or not. Information on a thickness is obtained by measuring a distance between paired grasping devices 41 (see FIG. 5), and judgment in step T3 is conducted by reading this information.

When thickness T is judged to be threshold value T0 or more in step ST3, thick coating is conducted in step ST4. Specifically, coating is conducted under the set situation wherein coating roller 51, shaping roller 56 and regulating member 504 in FIG. 9 are positioned to be low, and a distance between spine Sa of sheet bundle S1 and each of the aforesaid items is broad.

After coating of adhesive, the number of sheets S1*n* for the succeeding sheet bundle is counted.

When the counted number of sheets is not changed from the initial value, namely from the number of sheets S11 of a sheet bundle (Yes in ST7), the process returns to step ST4, and thick coating is conducted.

When steps ST4-ST7 are repeated and the job is terminated (Yes in ST5), the process flow is terminated.

When the number of sheets S1*n* of sheet S constituting a bundle of sheets is judged to be different from the initial value in step ST7 (No in step 7), the counted number of sheets is set as an initial value (ST2).

When a thickness of the bundle of sheets is judged to be thinner than threshold value T0 in step ST3 (No in step 3), thin coating is conducted in step ST8.

Specifically, thin coating is conducted under the condition wherein coating roller 51, shaping roller 56 and regulating member 504 in FIG. 9 are set to be high, and a distance between each of these items and spine Sa is made to be narrow.

In step ST9, existence of a job is judged, and when it is a job end (Yes in ST9), the process flow is terminated, while, when it is not a job end, the number of sheets S1*n*' of sheets S constituting following sheet bundle is counted in step ST10.

When the counted number of sheets is not changed from an initial value, the process returns to step ST8 to conduct thin coating, while, when the number of sheets is changed, the process returns to step ST2 to set the counted value in step ST10 as an initial value.

As illustrated in FIG. 11 and as described above, it is a basic method to select one of thick coating and thin coating according to a thickness of a sheet bundle. However, there is conducted coating control to coat while keeping a coating mode having been set before, when taking in information on the number of sheets constituting a bundle of sheets that is booklet information and there is no change in the booklet information.

Though the coating mode having been set before is kept when the counted number of sheets is not changed from the initial value in the example, the number does not always need to be the same, and it is naturally possible to keep the coating mode if a difference of the number of sheets is within a prescribed number of sheets.

Owing to this, it is prevented that a coating thickness is varied by fluctuation of a reading value of a thickness of a sheet bundle and that unevenness of an outer shape is caused between booklets.

Incidentally, it is possible to cause booklet information to include at least one of a thickness of each sheet (sheet thickness), a sheet size and a sheet type in addition to the number of sheets constituting a booklet.

Further, though the example of control in FIG. 11 is an example wherein two types of coating thicknesses are used for coating by using one threshold value, it is possible to conduct coating thickness control shown in FIG. 11 wherein booklet information is taken into consideration, even in the case of conducting coating three or more types of coating thicknesses by using plural thresholds.

What is claimed is:

1. A bookbinding apparatus which coats adhesive on a spine of a sheet bundle by moving relatively the sheet bundle or a coating device which coats adhesive to the spine for a plurality of sheet bundles including a foregoing sheet bundle and a following sheet bundle, one by one, the bookbinding apparatus comprising:

a thickness information generating device which generates information on a thickness of each of the sheet bundles, a booklet information generating device which generates booklet information including at least information on the number of sheets constituting each of the sheet bundles, and a control device which determines a coating mode of an adhesive layer to be coated on the spine of the foregoing sheet bundle based on the thickness information of the foregoing sheet bundle, and sets the coating mode as an initial coating mode and sets the booklet information of the foregoing sheet bundle as an initial booklet information, wherein, by comparing the booklet information of the following sheet bundle with the initial booklet information, the control device judges whether the coating mode of an adhesive layer to be coated on the spine of the following sheet bundle is the same as the initial coating mode or a coating mode of the adhesive layer for the following sheet bundle is newly determined based on the thickness information of the following sheet bundle.

2. The bookbinding apparatus of claim 1, wherein the booklet information includes at least one of information on a sheet thickness of the sheets constituting the sheet bundle, information on a size of the sheets, and information on a basis weight of the sheets and information on a type of the sheets.

3. The bookbinding apparatus of claim 1, wherein the thickness information generating device comprises a thickness detecting device which detects the thickness of the sheet bundle, wherein the control device conducts the coating mode determination based on an output from the thickness detecting device.

4. The bookbinding apparatus of claim 1, wherein even if the information on a thickness of the foregoing sheet bundle is different from the information on a thickness of the following sheet bundle, the control device does not change the coating mode by the comparison between the booklet information of the following sheet bundle and the initial booklet information when the booklet information on the following sheet bundle and the initial booklet information are the same.

5. The bookbinding apparatus of claim 1, further comprising:

a cover supporting device which adds a cover sheet to the sheet bundle; and a cutter which cuts the cover sheet to be supplied to the cover supporting device to a size suitable for the sheet bundle, wherein the control device controls a cutting position of the cutter based on the information on the thickness of the sheet bundle.

6. The bookbinding apparatus of claim 1, wherein the control device compares the information on the thickness of the sheet bundle with one or more threshold values and conducts the coating mode determination based on a result of the comparison.

7. The bookbinding apparatus of claim 1, wherein the coating device comprises a regulating device which regulates the coating thickness of the layer of the adhesive coated on the spine of the sheet bundle, wherein the control device adjusts the coating thickness of the layer of the adhesive by controlling a position of the regulating device.

8. The bookbinding apparatus of claim 1, further comprising a cover supporting device which bonds a cover sheet of a booklet to the spine of the sheet bundle coated with the adhesive.

9. A bookbinding system comprising:

an image forming apparatus which forms an image on a sheet; and the bookbinding apparatus of claim 1 which conducts a bookbinding process for the sheet ejected from the image forming apparatus.

10. The bookbinding apparatus of claim 1, wherein when the control device newly determines the coating mode of the following sheet bundle, the control device newly sets the determined coating mode as the initial coating mode and newly sets the booklet information of the following sheet bundle as the initial booklet information.

11. The bookbinding apparatus of claim 1, wherein the coating mode is a coating thickness.

12. The bookbinding apparatus of claim 1, wherein the coating mode includes a mode of thick coating and a mode of thin coating.

13. The bookbinding apparatus of claim 1, wherein even if the information on a thickness of the foregoing sheet bundle is different from the information on a thickness of the following sheet bundle, the control device does not change the coating mode by the comparison between the booklet information of the following sheet bundle and the initial booklet information when a difference between a number of sheets constituting a sheet bundle in the booklet information of the following sheet bundle and a number of sheets constituting a sheet bundle in the initial booklet information is smaller than a predetermined number.

* * * * *